US010094101B1

(12) United States Patent
Jazzar

(10) Patent No.: US 10,094,101 B1
(45) Date of Patent: Oct. 9, 2018

(54) PRECAST CONCRETE SYSTEM WITH RAPID ASSEMBLY FORMWORK

(71) Applicant: Mohammad Omar A. Jazzar, Clearwater, FL (US)

(72) Inventor: Mohammad Omar A. Jazzar, Clearwater, FL (US)

( * ) Notice: Subject to any disclaimer, the term of this patent is extended or adjusted under 35 U.S.C. 154(b) by 0 days.

(21) Appl. No.: 15/858,589

(22) Filed: Dec. 29, 2017

(51) Int. Cl.

| | |
|---|---|
| ***E04B 1/20*** | (2006.01) |
| ***E04B 1/04*** | (2006.01) |
| ***E04B 5/04*** | (2006.01) |
| ***E04B 5/32*** | (2006.01) |
| ***E04B 5/38*** | (2006.01) |
| ***E04C 3/34*** | (2006.01) |
| ***E04B 5/02*** | (2006.01) |
| *E04G 11/36* | (2006.01) |
| *E04C 2/04* | (2006.01) |
| *E04C 2/06* | (2006.01) |

(52) U.S. Cl.
CPC ..... *E04B 1/04* (2013.01); *E04B 1/20* (2013.01); *E04B 5/04* (2013.01); *E04B 5/32* (2013.01); *E04B 5/38* (2013.01); *E04C 2/50* (2013.01); *E04C 3/34* (2013.01); *E04B 2005/322* (2013.01); *E04B 2103/02* (2013.01); *E04C 2/044* (2013.01); *E04C 2/06* (2013.01); *E04G 11/36* (2013.01)

(58) Field of Classification Search
CPC ..... E04B 1/04; E04B 1/20; E04B 5/04; E04B 5/32; E04B 5/38; E04B 2103/02; E04B 2005/322; E04C 2/06; E04C 2/50; E04C 2/044; E04C 3/34; E04G 11/36; B28B 1/14; B28B 1/16
USPC ... 52/745.13, 236.3, 236.5, 236.8, 252, 259, 52/260, 283, 741.14; 264/34, 35
See application file for complete search history.

(56) References Cited

U.S. PATENT DOCUMENTS 938,458 A * 11/1909 Brockhausen ..... E04B 5/43 256/19
1,380,324 A * 5/1921 Piggins ..... E04B 1/215 52/236.7
1,496,819 A * 6/1924 William ..... B28B 23/18 264/269
2,720,017 A * 10/1955 Youtz ..... E04B 1/35 264/34
2,871,544 A * 2/1959 Youtz ..... E04B 1/35 249/23
3,354,593 A * 11/1967 Ber Zukas ..... E04B 1/21 52/125.1

(Continued)

*Primary Examiner* — Charles A Fox
*Assistant Examiner* — James J Buckle, Jr.
(74) *Attorney, Agent, or Firm* — Larson & Larson, P.A.; Justin P. Miller; Patrick A. Reid

(57) ABSTRACT

The disclosed system divides the precast and cast-in-place construction into vertical and horizonal components. The vertical components are precast, permitting rapid vertical building construction without a delay for concrete to set. The two primary precast components are a column that includes a horizontal inflexible slab portion, and a central panel placed diagonally between columns. Each precast component is a weight and size that is readily manageable using a standard construction crane.
The horizontal components are a combination of cast-in-place, and precast components. The result creates a continuous unitary floor structure that carries larger loads with less thickness that purely simple span pre-cast construction.

12 Claims, 11 Drawing Sheets

(56) References Cited

U.S. PATENT DOCUMENTS 3,490,191 A * 1/1970 Ekblom ..... E04B 1/20 52/125.1
3,524,293 A * 8/1970 Leyten ..... E04B 1/161 249/19
3,613,325 A * 10/1971 Yee ..... E04B 1/20 52/236.8
4,081,935 A * 4/1978 Wise ..... E04B 1/21 52/236.8
4,409,764 A * 10/1983 Wilnau ..... E04B 1/165 52/127.3
5,367,854 A * 11/1994 Kim ..... E04G 21/06 264/426
5,507,124 A * 4/1996 Tadros ..... E04B 5/43 52/251
5,787,663 A * 8/1998 Wehrmann ..... E04B 5/14 403/217
5,809,712 A * 9/1998 Simanjuntak ..... E04C 5/08 52/223.7
5,845,457 A * 12/1998 Wybauw ..... B28B 7/0064 52/745.2
7,121,061 B2 10/2006 Jazzar
8,011,147 B2 * 9/2011 Hanlan ..... E04B 1/20 52/236.3
8,549,805 B2 * 10/2013 Kim ..... E04C 5/0645 52/253
8,844,223 B2 * 9/2014 Zhong ..... E04B 1/161 52/259
9,371,648 B1 * 6/2016 Tikhovskiy ..... E04B 5/18
9,683,361 B2 * 6/2017 Timberlake ..... E04B 1/167
2001/0003234 A1 * 6/2001 Van Doren ..... E04B 1/165 52/251
2005/0210762 A1 * 9/2005 Broberg ..... E04B 1/34807 52/79.1
2010/0024332 A1 * 2/2010 Valaire ..... E04B 5/38 52/252
2011/0131908 A1 * 6/2011 Lee ..... E04B 1/04 52/283
2013/0074430 A1 * 3/2013 Morcous ..... E04B 5/16 52/252
2016/0122996 A1 * 5/2016 Timberlake ..... E04C 5/0604 52/236.3

* cited by examiner

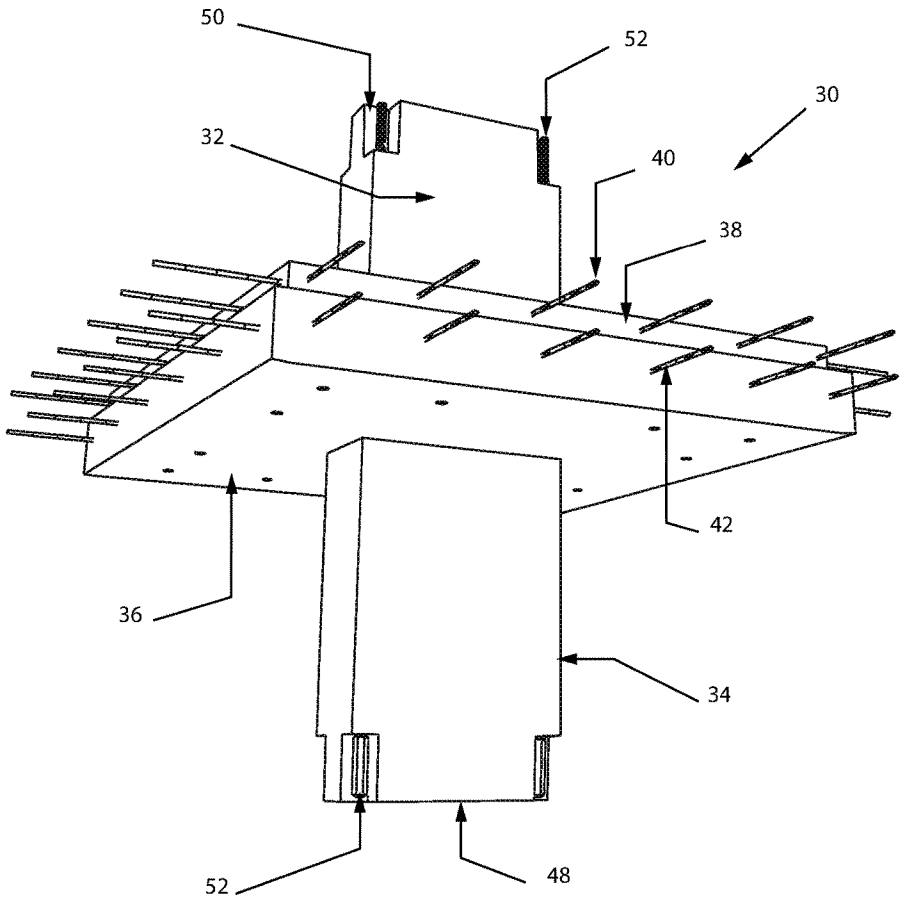
Figure # 1

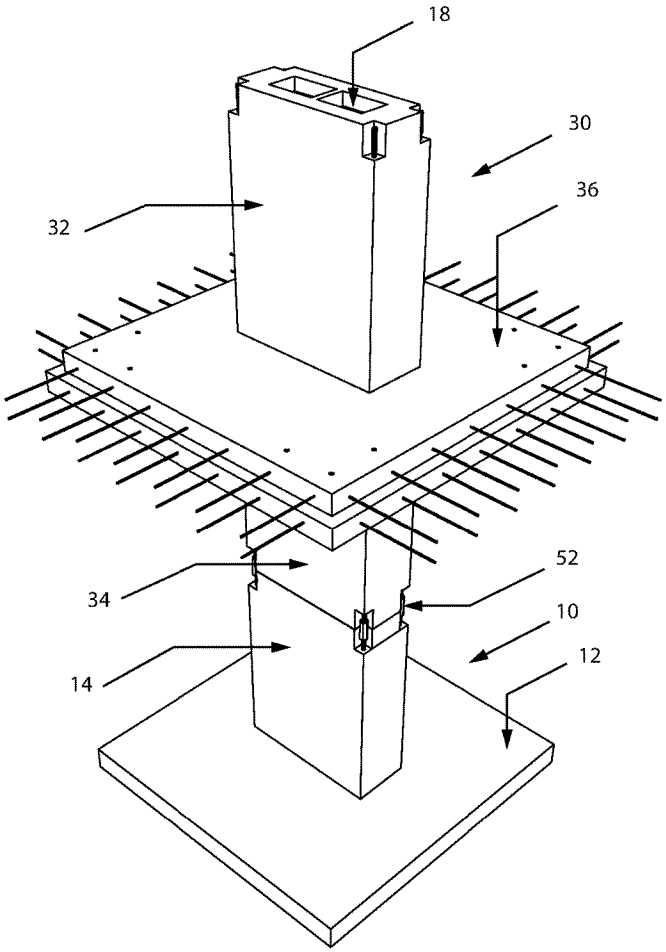
Figure # 2

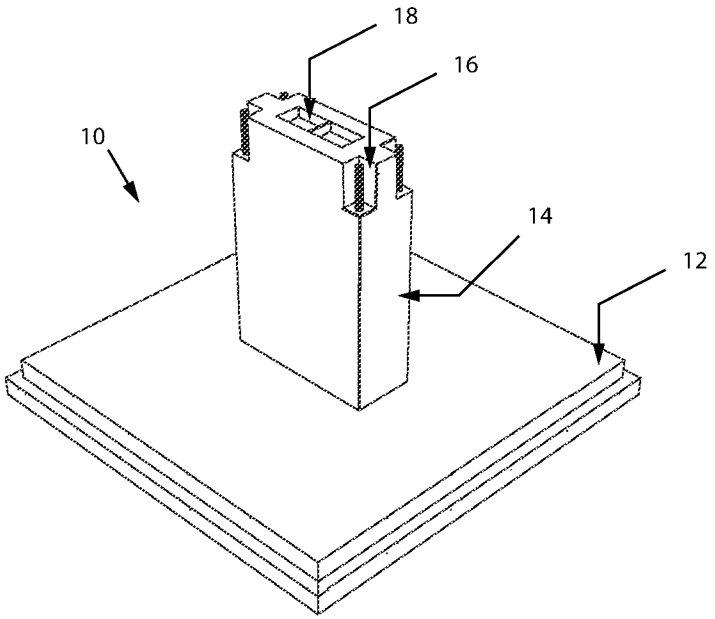
Figure # 3

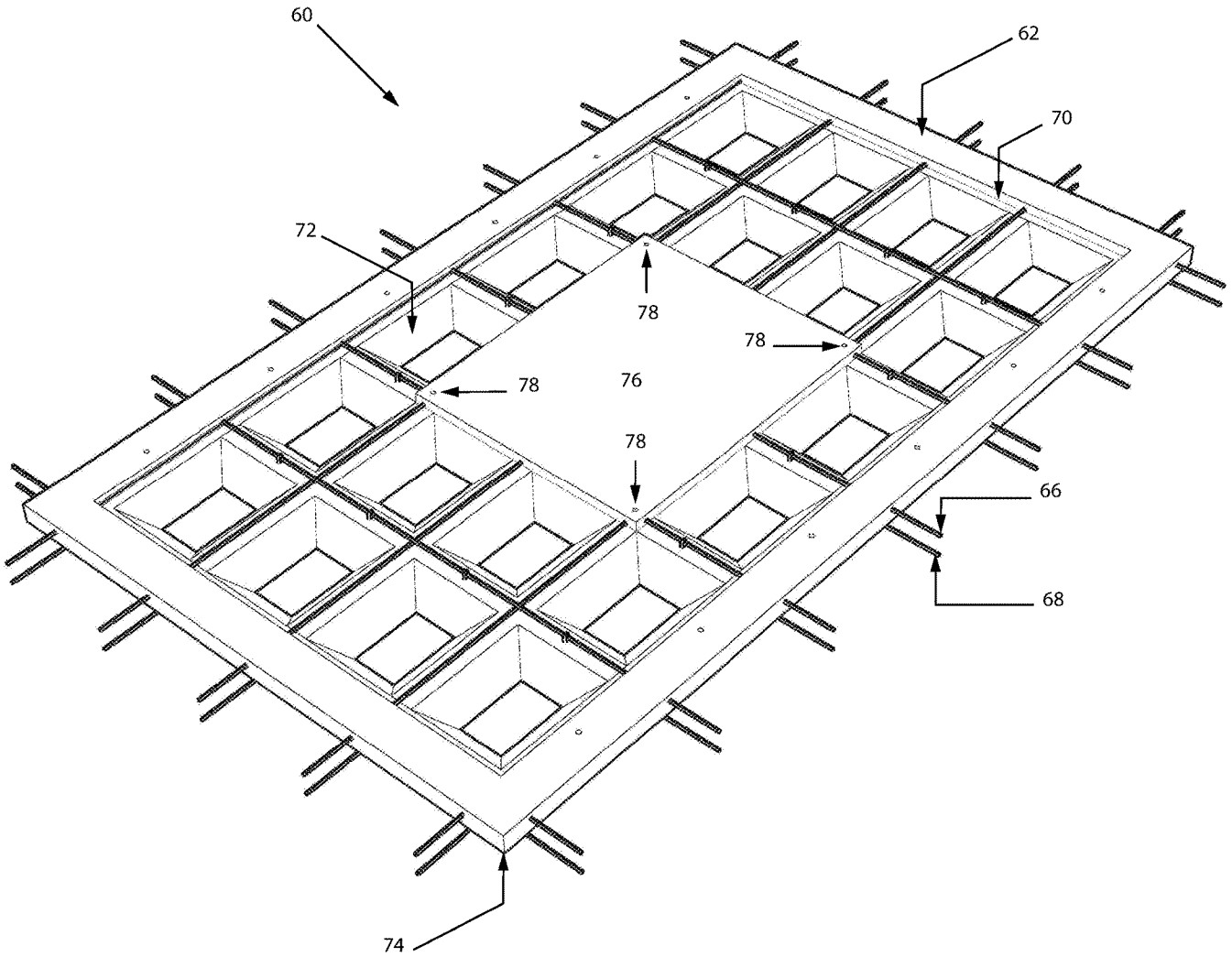
Figure # 4

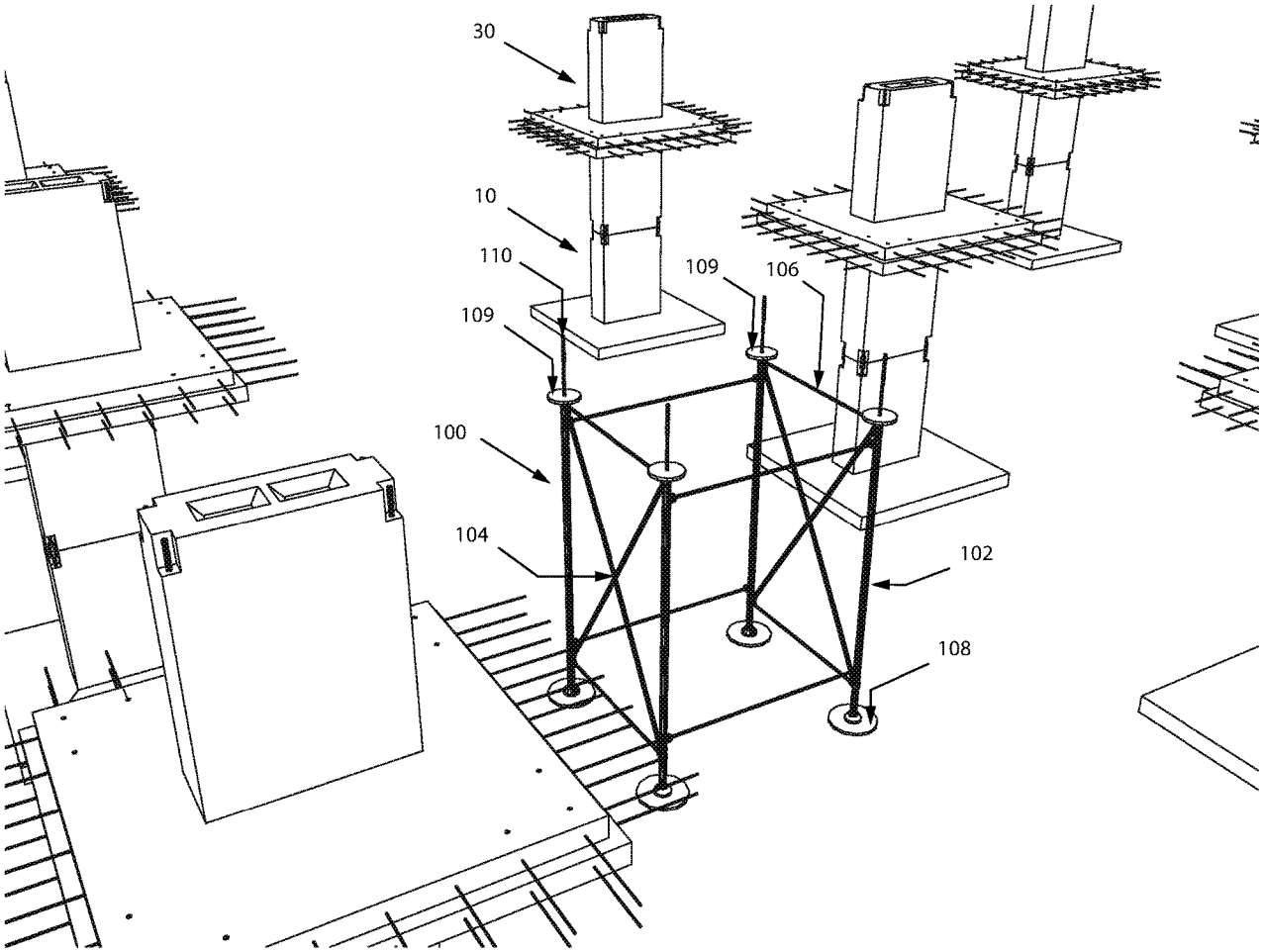
Figure # 5

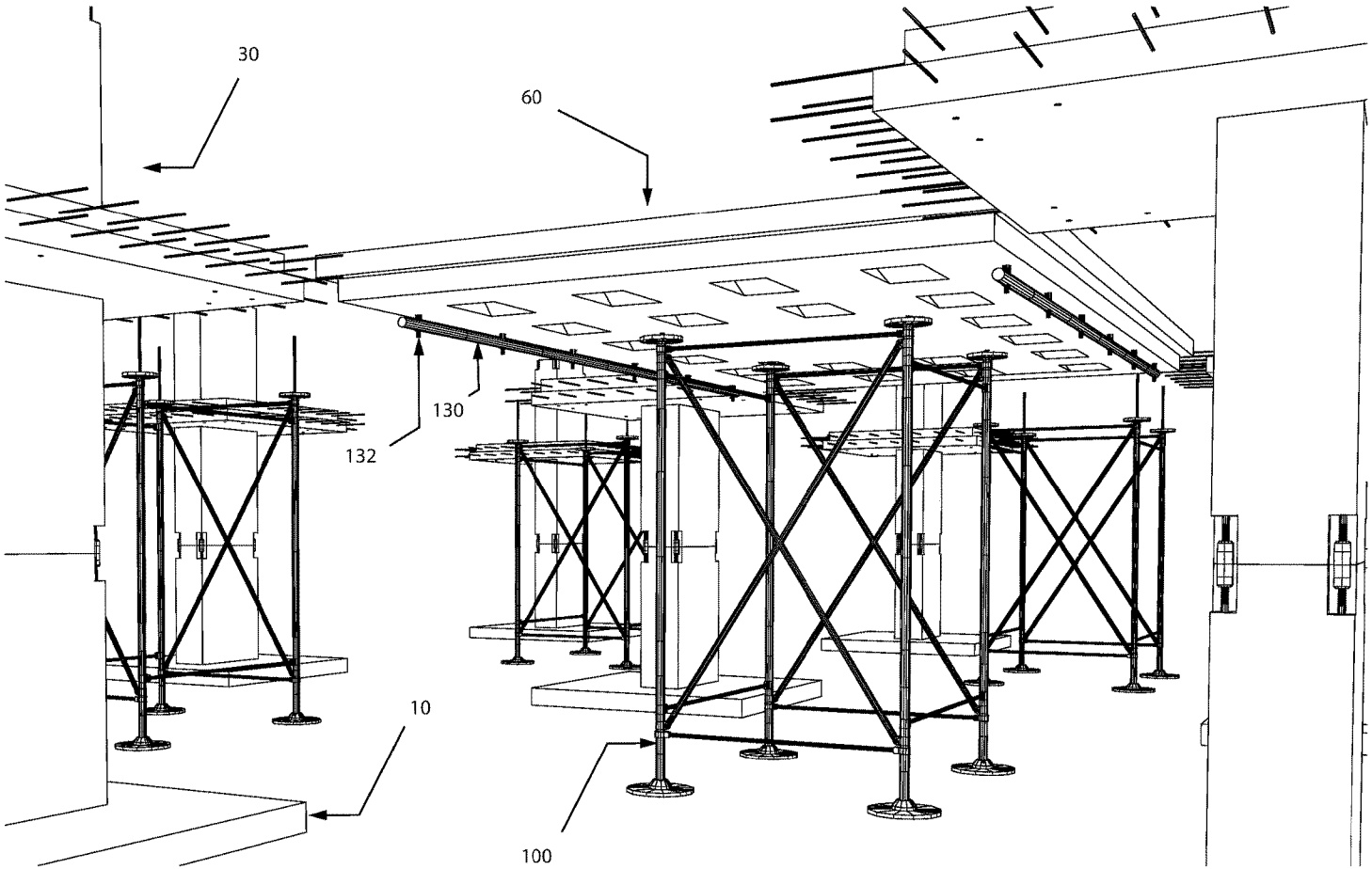
Figure # 6

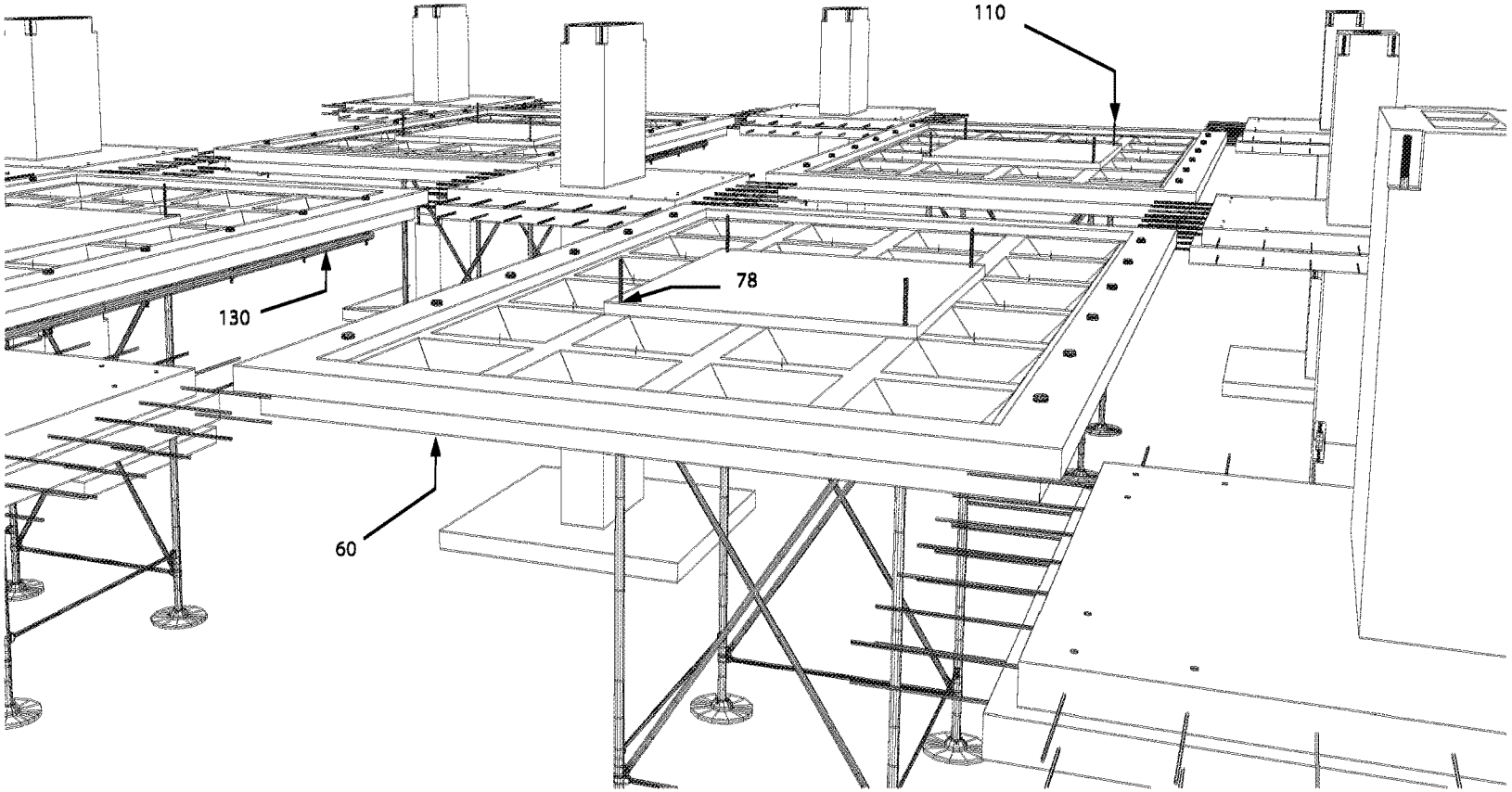
Figure # 7

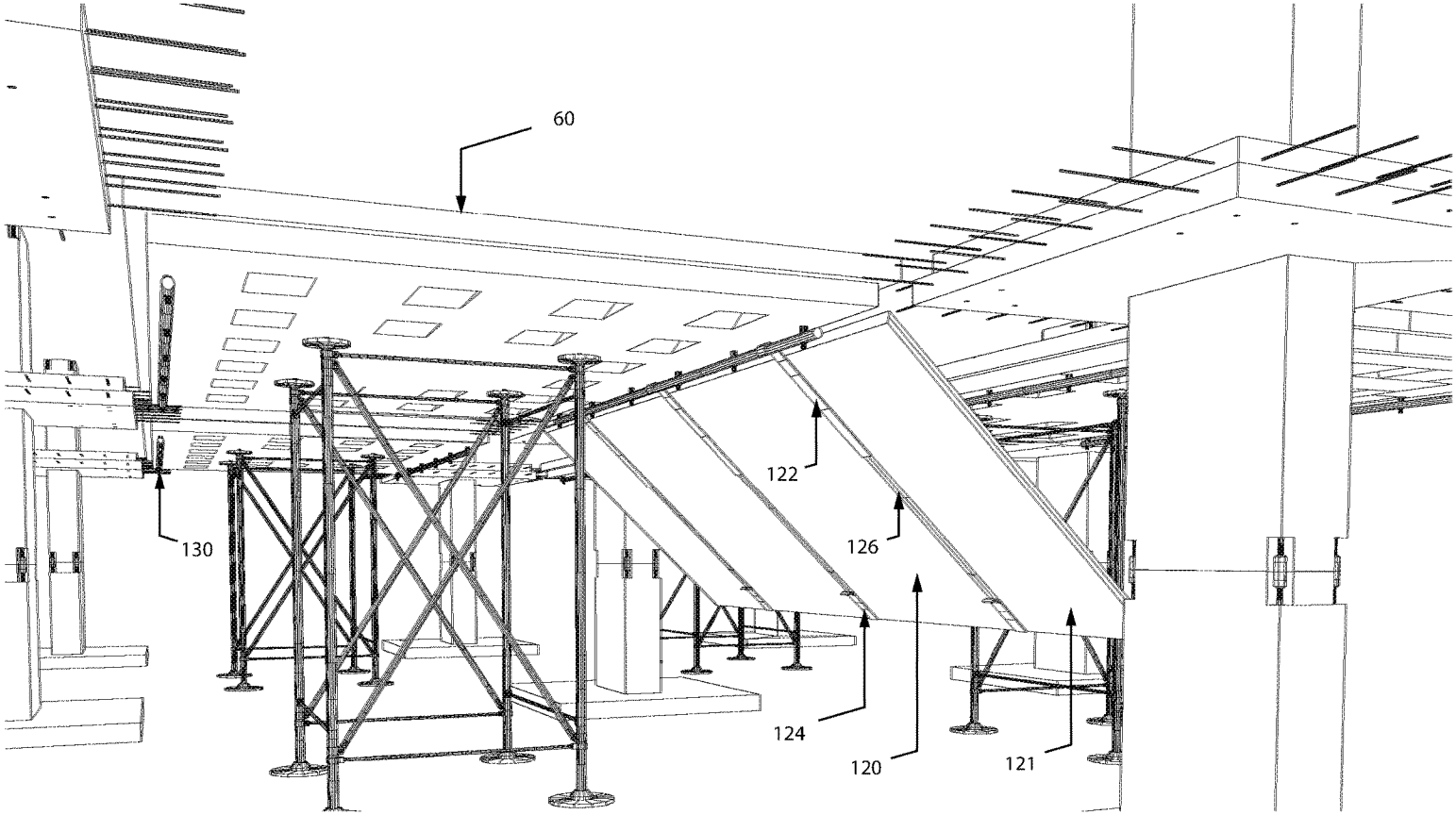
Figure # 8

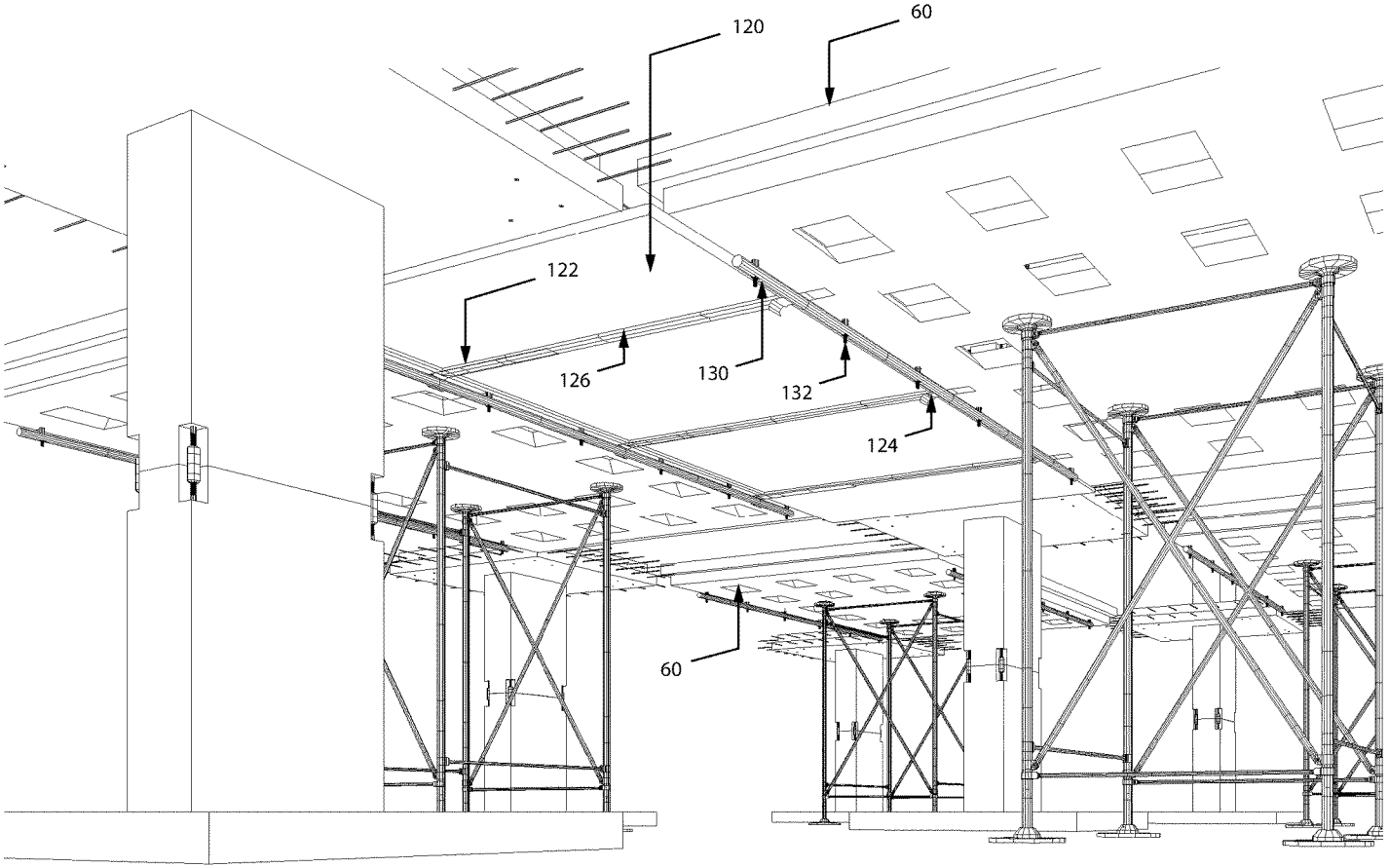
Figure # 9

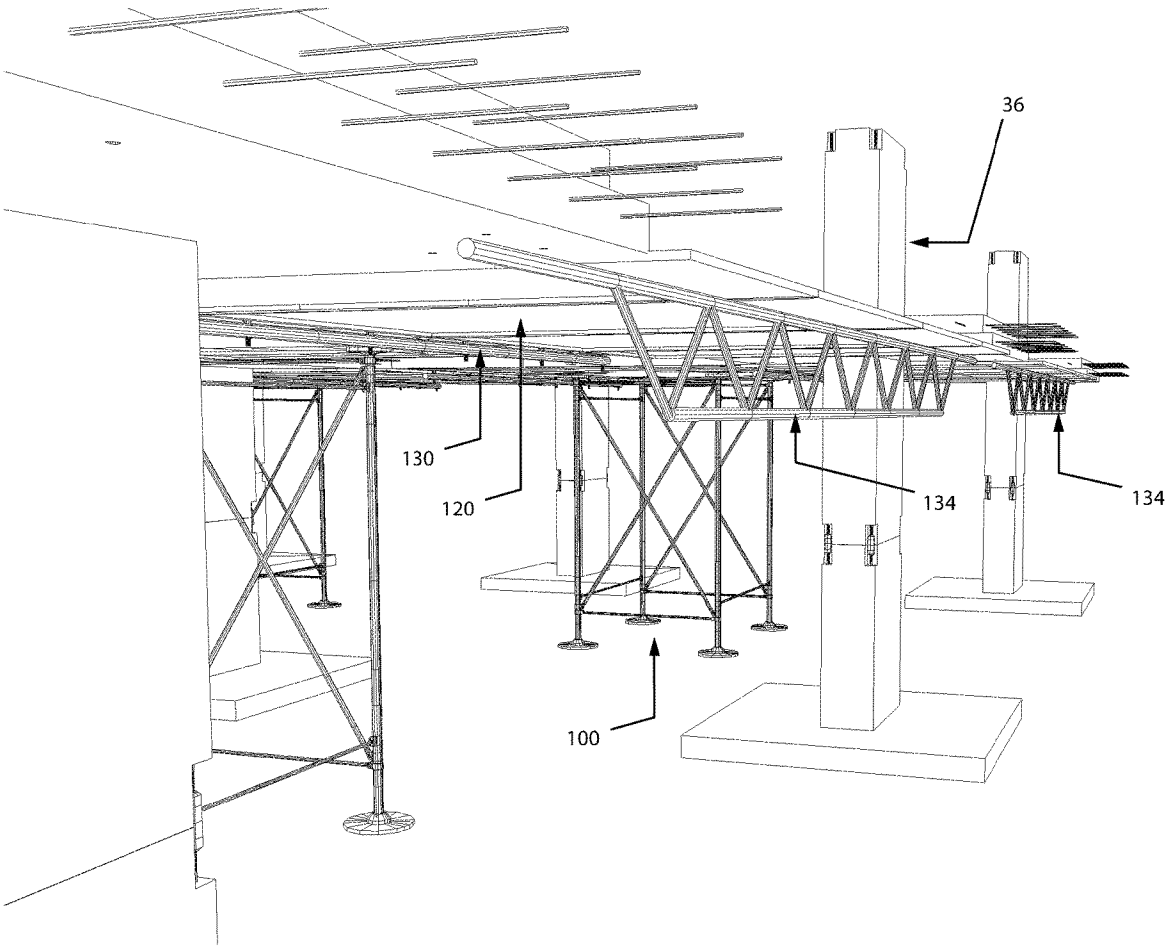
Figure # 10

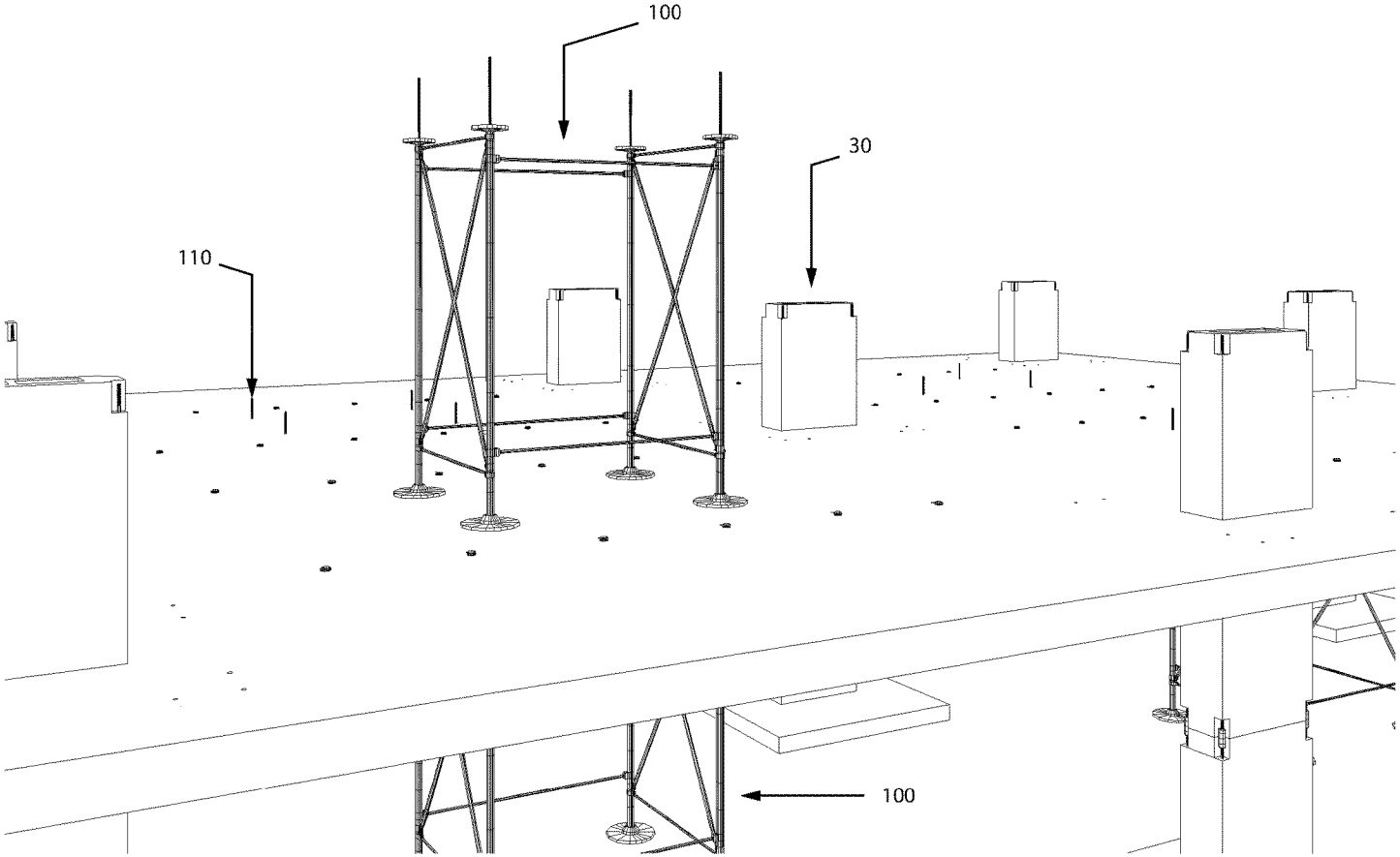
Figure # 11

PRECAST CONCRETE SYSTEM WITH RAPID ASSEMBLY FORMWORK

FIELD

This invention relates to the field of building construction and more particularly to a system for the rapid construction of buildings using a hybrid mix of precast and poured concrete construction.

BACKGROUND

The construction material of choice for modern multi-story structures is concrete. A durable material, and readily available around the world, it can be used to form floors, walls, and columns that eventually result in a complete building.

Conventional cast-in-place concrete construction relies on the use of labor-intensive, time-consuming, bulky, built-in-place formwork that must be erected for each wall, column. The formwork takes up space that could be used for moving around the site in the floor below, and does so for the duration of the construction. This process alone is time-consuming. After the formwork is placed, concrete is poured within the forms. This concrete is allowed to partially cure, then the formwork is removed and after twenty-eight days, the concrete can bear its full load. The result of these delays is the slow the speed of construction.

Given the time-consuming nature of cast-in-place concrete, the concept of casting off-site arose, with the pre-cast concrete pieces then being assembled on-site. While moving the slow and time-consuming process of pouring concrete and wait for cure, to an off-site location, does speed up the process of construction, the resulting structure lacked the strength of a cast-in-place building due to weak connectivity.

Additionally, because the pre-cast concrete must be transported to the construction site, the panel size is limited. The result is a building made from many separate panels that fail to transfer loads to adjacent bays as in the case of poured-in-place structures.

What is needed is a system for constructing a building that combines the strength and continuity of cast-in-place construction with the rapid assembly of precast construction, thus maintaining structural continuity between bays and floors by redistributing stresses to adjacent bays.

SUMMARY

The disclosed system divides the precast and cast-in-place construction into vertical and horizonal components. The vertical components are precast, permitting rapid building construction without a delay for concrete to set and gain strength. The two primary precast components are a column that includes a slab portion, and a central panel placed diagonally between four columns. Each precast component is a weight and size that is readily manageable using a standard construction crane.

The horizontal components are a combination of cast-in-place, and precast components. The result creates a unitary floor structure that carries larger loads with less thickness that purely pre-cast construction.

The horizontal components that require vertical support during the curing process are supporting using temporary means, which are easily erected by hand. Given that the building can be assembled with vertical components that have already gained strength, and thus can be stressed, the weight of the fresh concrete, which is suspended from the cured pre-cast components of the horizontal structure, the cast-in-place concrete is permitted to cure without resulting delays in construction.

The resulting structure can be erected as quickly as the crane can pick and place the components. For example, a ten-story structure can be assembled in two weeks.

The disclosed combination of pre-cast and cast-in-place elements maintains the quick erection of a pre-cast system, with the improved strength of a cast-in-place system.

Existing systems use pre-cast panels that are formed in a factory. Precast pieces are made by:

- Cutting, bending, and connecting rebar to form an internal reinforcement;
- Surrounding the rebar with a form;
- Filling the form with concrete;
- Permitting the concrete to cure; and
- Removing the cast piece from the form.

While the resulting pieces may be quickly assembled on-site, the pre-cast pieces remain as individual pieces. As a result, any applied bending moment does not cross to adjacent pre-case pieces. As a result, the moments are concentrated in shorter spans, rather than being spread and redistributed across greater lengths thus tampering their intensity.

The difference in strength is a significant 1.5 times:

Moment calculation for standard precast system:

$$M = \frac{1}{8}WL^2$$

Moment calculation for disclosed system with joined span:

$$M = \frac{1}{12}WL^2$$

Reducing the moments requires joining the beams across the length and width of the building. If the beams act as a unitary structure, the resulting beams can be thinner while still being the same strength. The result is a finished building with a greater number of stories than an equivalent purely pre-cast structure due to a reduction in both beam and slab depth.

The reduction in weight also reduces column and foundation sizing,

Turning now to the pieces that make up the structure: The system is divided into permanent structure, or pre-cast pieces, and temporary structure, or formwork.

The permanent structure is comprised of two primary pre-cast pieces—a central member and a spanning member.

The central member includes a vertical column that is optionally divided by a horizontal slab. Rebar runs end-to-end through the horizontal slab, protruding from all sides. This rebar is later incorporated into the cast-in-place platforms that surround the central horizontal panel where it always overlaps with the incoming steel sufficiently to create a continuous moment bond.

The edges of the horizontal slab are stepped with the lower face offset 15 cm inward.

The vertical column includes steel bars that, using threaded rod and protracted nuts, act to connect each column to its neighboring columns both above and below. Included within the upper and lower faces of the columns are one or more centered keys, used both as shear keys and to ease placement of columns above.

Turning to the spanning member, it is a substantially square or rectangular slab. The spanning member is intended to be placed diagonally between central members in a horizontal plane. Substantial portions of the spanning member include empty cavities, making the upper surface look like a waffle. the empty spaces lighten the spanning member, making each panel much lighter and placement less difficult. The empty chambers are later filled with concrete.

The top seven centimeters of the empty chambers forming the floor slab are optionally filled in prior to, or during, construction using a low-density material. For example, extruded polystyrene foam, or a similar material. The low-density material is then covered with concrete prior to, or during, construction. By building the spanning member from a lightweight core surrounded by concrete, weight is reduced while the majority of strength is maintained. The cavities are tapered inward to act as a sub-form, restraining the concrete from falling.

The empty chambers are preferably tapered from top to bottom.

The center of the spanning member, between the empty cavities is filled in. The filled-in portion permits support of a collapsible tower.

The collapsible towers permit each spanning member to support the spanning members placed above.

Rebar exits the edges of the spanning member, both from the upper portion of the stepped edge and the lower portion.

Turning to the formwork and erection system, it is comprised of two primary parts: A collapsible tower for supporting successive waffle pieces; and a panel that is hung and rotated into place, creating the only formwork between the waffles and central column vertical slabs.

An explanation of the construction process will aid an understanding of how the formwork and erection system work with the pre-cast pieces to result in the desired structure.

The first step to erecting a structure using the disclosed system is to excavate to a depth sufficient for placement of the base columns.

Next, the base columns are installed, with the flat horizontal slab of each resting against the excavated surface.

Next, a subsequent layer of central members is placed, each central member resting on a base column.

Optionally, a base slab is poured that fixes the base columns in place and presents a flat surface for placement of the collapsible towers.

Next, a collapsible tower is placed in the center of each set of four columns. Each collapsible tower includes locating pins that protrude from its top to help locate the spanning member placed above.

Then, a spanning member is placed on top of the collapsible tower. The locating pins of the collapsible tower fit within penetrations of the spanning member, and temporarily bolted in place.

Hanging beneath each edges of each spanning member are formwork support rods.

Next, the rotating formwork panels are hooked to their respective formwork support rod, then rotated upward into place. The slideable support brackets are moved into place, latching into gaps between the formwork support rod and the spanning member.

The outer edges lack spanning members, and thus lack formwork support rods. In order to hold the rotating formwork panels in place, temporary trusses or stilts are placed between the central members along the edge.

With the formwork placed, rebar, wiring, and other utilities are placed as needed.

Then the spaces within the spanning member, as well as between the spanning members and the central members, are filled with concrete.

Construction can nearly immediately move to the next floor. The collapsible towers are placed and spanning members set, then moving on to more formwork.

Generally, after three subsequent floors are placed and poured, the first set of formwork can be removed and moved up to the top floor. This rotation progress upward until the building reaches its desired height.

BRIEF DESCRIPTION OF THE DRAWINGS

The invention can be best understood by those having ordinary skill in the art by reference to the following detailed description when considered in conjunction with the accompanying drawings in which:

FIG. 1 illustrates a view of an embodiment of the central member.

FIG. 2 illustrates a view of an embodiment of the central member placed atop a base member.

FIG. 3 illustrates an embodiment of a base member.

FIG. 4 illustrates an embodiment of a spanning member.

FIG. 5 illustrates an embodiment of a collapsible tower placed between base members.

FIG. 6 illustrates an embodiment supporting a spanning member.

FIG. 7 illustrates the locating pins of the collapsible tower penetrating a spanning member.

FIG. 8 illustrates an embodiment of the rotating formwork, hanging from a spanning member.

FIG. 9 illustrates an embodiment of the rotating formwork, hanging between spanning members.

FIG. 10 illustrates an embodiment of the support trusses used to hold the position of the temporary formwork along the outer edges.

FIG. 11 illustrates the placement of a collapsible tower atop a spanning member, with a lower collapsible tower supporting the spanning member from below.

DETAILED DESCRIPTION

Reference will now be made in detail to the presently preferred embodiments of the invention, examples of which are illustrated in the accompanying drawings. Throughout the following detailed description, the same reference numerals refer to the same elements in all figures.

Referring to FIG. 1, a view of an embodiment of the central member is shown. The central member 30 is formed from an upper column portion 32 and a lower column portion 34, with a dividing slab 36 placed between.

A perimeter notch 38 follows the edge of the dividing slab 36. Protruding from the edge of the dividing slab 36 are continuous central member upper rebar 40 and continuous central member lower rebar 42.

Hidden is the shear key 48 used to connect the central member 30 to the columns above or below itself.

Along the bottom and top corners are the corner connection cutouts 50, which make room for the column vertical rods 52. Their use is discussed further below.

The dividing slab 36 may be located at other positions with respect to the central member 30, and thus need not be centered top-to-bottom. The building design may necessitate placement of the dividing slab 36 at points such as the bottom of the central member 30, top of the central member 30, or at other locations between.

Referring to FIG. 2, a view of an embodiment of the central member placed atop a base member is shown.

A central member 30 is shown placed atop a base member 10, which is formed from a base slab 12 and vertical base rectangular column 14. The column vertical rods 52 are connected to each other, locking the lower column portion 34 to the base rectangular column 14 to prevent uplift.

Referring to FIG. 3, an embodiment of a base member is shown.

The base member 10 includes a base slab 12 and base rectangular column 14. A corner threaded rod 16 is placed on the corners of the base rectangular column.

One or more shear key receiving cavities 18 aid in placement of upper columns and help to prevent twisting.

Referring to FIG. 4, an embodiment of a spanning member is shown.

The spanning member 60 includes a perimeter wall 62 that bounds a central cavity 70. The central cavity 70 is divided into a multiplicity of individual cavities 72 that are later filled with concrete.

The individual cavities 72 are optionally filled with a plug of lightweight material before being covered with concrete. For example, an expanded foam may be used, then covered with a concrete layer. Or a concrete that is lightweight, either by using a lightweight mix or a novel type of concrete, such as autoclaved aerated concrete, may be used. The result is a lightweight spanning member 60 that maintains the majority of its strength.

Continuous spanning member upper rebar 66 and continuous spanning member lower rebar 68 are shown protruding above and below the inverted perimeter notch 74.

A central supporting face 76 is pre-formed, later used to support a collapsible tower (not shown). The pin penetrations 78 will interface with locating pins of the collapsible tower to aid in proper placement of the spanning member 60.

Referring to FIG. 5, an embodiment of a collapsible tower placed between base members is shown.

The collapsible tower 100 is preferably formed from four posts 102, held in position by cross braces 104 and horizontal braces 106. At the bottom of each post 102 is a base plate 108. At the upper end of each post 102 is a top plate 109. Protruding beyond the top plate 109 is a locating pin 110, which will interface with the pin penetrations 78 of the spanning member 60 (not shown).

Referring to FIG. 6, an embodiment supporting a spanning member is shown.

The spanning member 60 is shown placed atop a collapsible tower 100. Along each edge is a formwork support rods 130, held to the spanning member by fasteners 132.

Referring to FIG. 7, the locating pins of the collapsible tower penetrating a spanning member is shown.

This topside view of the spanning member 60 shows the locating pins 110 protruding through the pin penetrations 78, aiding placement of the spanning member 60. Furthermore, the subsequent collapsible tower 100 (not shown) is placed on top of the locating pins 110 to maintain alignment as the structure grows higher.

Referring to FIG. 8, an embodiment of the rotating formwork, hanging from a spanning member, is shown.

A rotating formwork panel 120 is shown with its fixed hooks 122 rotating above the formwork support rod 130 attached to the spanning member 60. The solid panel 121 will support the concrete that will be poured above. One or more optional stiffeners 126 increase the rigidity of the rotating formwork panel 120 to support the weight of the concrete. The slideable hooks 124 are shown hanging from the rotating formwork panel 120, not yet in a position to provide support.

Referring to FIG. 9, an embodiment of the rotating formwork, hanging between spanning members, is shown.

The rotating formwork panel 120 is now supported along both edges, with the fixed hooks 122 providing support along one edge, and the slideable hooks 124 inserted between the spanning member 60 and formwork support rod 130. The formwork panel 120 is now ready to support pour concrete.

Referring to FIG. 10, an embodiment of the support trusses used to hold the position of the temporary formwork along the outer edges is shown.

The trusses 134 support the rotating formwork panels 120 along their outer edge. The trusses are affixed to the dividing slabs 36 using fasteners 132.

Referring to FIG. 11, the placement of a collapsible tower atop a spanning member, with a lower collapsible tower supporting the spanning member from below, is shown.

The collapsible tower 100 is in position to support a subsequently placed spanning member 60, and so construction proceeds.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method of erecting a multi-story structure, the method comprising the steps of:

a. excavating a building site to create an excavated surface;

b. placing one or more base members against the excavated surface, each base member comprised of:

i. a horizontal slab;

ii. a vertical column extended from the horizontal slab;

c. placing a central member atop each vertical column of each of the one or more base members, each central member comprised of:

i. an upper column portion;

ii. a lower column portion;

iii. a dividing slab between the upper column portion and the lower column portion;

d. erecting a collapsible tower between the central members, each collapsible tower comprised of:

i. one or more posts connected by one or more horizontal braces;

ii. two or more locating pins protruding from the top of each of the one or more posts;

e. placing a spanning member atop each collapsible tower, each spanning member comprised of:

i. a perimeter wall surrounding a central cavity;

ii. a multiplicity of individual cavities within the central cavity;

iii. a central supporting face centered within the central cavity, the central supporting face have one or more pin penetrations that align with the two or more locating pins of the collapsible tower during placement;

iv. one or more formwork support rods affixed to a base of the spanning member;

f. affixing a rotating formwork panel to the one or more formwork support rods of the spanning member, each rotating formwork panel comprised of:

i. a solid panel;

ii. fixed hooks adapted to rotate around the formwork support rods of the spanning member;

iii. slideable hooks to affix to formwork support rods after rotation of the panel into place;

g. pouring concrete on top of the rotating formwork panels, thereby filling the spaces between the dividing slabs and spanning member;

h. pouring concrete into the central cavity of the spanning member, thereby filling the individual cavities;

i. repeating steps c through h, each time completing a floor of the multi-story structure, stopping when the multi-story structure is the desired number of floors.

2. The method of erecting a multi-story structure of claim 1, wherein steps c through h are performed three times to construct three stories, followed by the step of:

h1. removing the collapsible tower form the lowermost floor for use on the subsequently constructed floor.

3. The method of erecting a multi-story structure of claim 1, wherein:

the base member further comprises:

a shear key receiving cavity located on top of the vertical column; and the central member further comprises;

a shear key located beneath the lower column portion;

wherein the shear key interfaces with the shear key receiving cavity when the central member is placed atop the base member.

4. The method of erecting a multi-story structure of claim 1, wherein the spanning member further comprises:

continuous central member upper rebar that includes a portion within the spanning member and a portion that extends beyond the spanning member; and continuous central member lower rebar that includes a portion within the spanning member and a portion that extends beyond the spanning member.

5. A method of erecting a multi-story structure, the method comprising the steps of:

a. excavating a building site to create an excavated surface;

b. placing one or more base members against the excavated surface, each base member comprised of:

i. a horizontal slab;

ii. a vertical column extended from the horizontal slab;

c. placing a central member atop each vertical column of each of the one or more base members, each central member comprised of:

i. an upper column portion;

ii. a lower column portion;

iii. a dividing slab;

d. erecting a collapsible tower between the central members, each collapsible tower comprised of:

i. one or more posts connected by one or more horizontal braces;

ii. a locating pin protruding from the top of each of the one or more posts;

e. placing a spanning member atop each collapsible tower, each spanning member comprised of:

i. a perimeter wall surrounding a central cavity;

ii. a multiplicity of individual cavities within the central cavity;

iii. a central supporting face centered within the central cavity, the central supporting face have one or more pin penetrations that align with the locating pins of the collapsible tower during placement;

iv. one or more formwork support rods affixed to a base of the spanning member;

f. hanging a rotating formwork panel from one formwork support rods of the spanning member, each rotating formwork panel comprised of:

i. a solid panel;

ii. fixed hooks adapted to rotate around the formwork support rods of the spanning member;

iii. slideable hooks to affix to formwork support rods after rotation of the panel into place;

g. lifting the rotating formwork panel into a horizontal position;

h. sliding the slideable hooks of the rotating formwork panel into an adjacent formwork support rod;

i. pouring concrete on top of the rotating formwork panels, thereby filling the spaces between the dividing slabs and spanning member;

j. pouring concrete into the central cavity of the spanning member, thereby filling the individual cavities;

k. repeating steps c through j, each time completing a floor of the multi-story structure, stopping when the multi-story structure is the desired number of floors.

6. The method of erecting a multi-story structure of claim 5, wherein steps c through h are performed three times to construct three stories, followed by the step of:

j1. removing the collapsible tower form the lowermost floor for use on the subsequently constructed floor.

7. The method of erecting a multi-story structure of claim 5, wherein:

the base member further comprises:

a shear key receiving cavity located on top of the vertical column; and the central member further comprises;

a shear key located beneath the lower column portion;

wherein the shear key interfaces with the shear key receiving cavity when the central member is placed atop the base member.

8. The method of erecting a multi-story structure of claim 5, wherein the spanning member further comprises:

continuous central member upper rebar that includes a portion within the spanning member and a portion that extends beyond the spanning member; and continuous central member lower rebar that includes a portion within the spanning member and a portion that extends beyond the spanning member.

9. A method of erecting a multi-story structure, the method comprising the steps of:

a. excavating a building site to create an excavated surface;

b. placing one or more base members against the excavated surface, each base member comprised of:

i. a horizontal slab;

ii. a vertical column extended from the horizontal slab;

c. placing a central member atop each vertical column of each of the one or more base members, each central member comprised of:

i. an upper column portion;

ii. a lower column portion;

iii. a dividing slab;

iv. upper rebar located within the dividing slab;

v. lower rebar located within the dividing slab;

d. erecting a collapsible tower between the four central members, each collapsible tower comprised of:
   i. one or more posts connected by one or more horizontal braces;
   ii. a base plate at a bottom of each of the one or more posts;
   iii. a top plate at a top of each of the one or more posts;
   iv. a locating pin protruding from the top of each of the one or more posts, protruding through the top plate;
e. placing a spanning member atop each collapsible tower, each spanning member comprised of:
   i. a perimeter wall surrounding a central cavity;
   ii. a multiplicity of individual cavities within the central cavity;
   iii. a central supporting face centered within the central cavity, the central supporting face having one or more pin penetrations that align with the locating pins of the collapsible tower during placement;
   iv. one or more formwork support rods affixed to a base of the spanning member;
f. affixing a rotating formwork panel to the one or more formwork support rods of the spanning member, each rotating formwork panel comprised of:
   i. a solid panel;
   ii. fixed hooks adapted to rotate around the formwork support rods of the spanning member;
   iii. slideable hooks to affix to adjacent formwork support rods after rotation of the panel into place;
g. pouring concrete on top of the rotating formwork panels, thereby filling the spaces between the dividing slabs and spanning member;
h. pouring concrete into the central cavity of the spanning member, thereby filling the individual cavities;
i. repeating steps c through h, each time completing a floor of the multi-story structure, stopping when the multi-story structure is the desired number of floors.

10. The method of erecting a multi-story structure of claim 9, wherein steps c through h are performed three times to construct three stories, followed by the step of:

h1. removing the collapsible tower form the lowermost floor for use on the subsequently constructed floor.

11. The method of erecting a multi-story structure of claim 9, wherein:

the base member further comprises:
   a shear key receiving cavity located on top of the vertical column; and
the central member further comprises;
   a shear key located beneath the lower column portion;
wherein the shear key interfaces with the shear key receiving cavity when the central member is placed atop the base member.

12. The method of erecting a multi-story structure of claim 9, wherein the spanning member further comprises:

continuous central member upper rebar that includes a portion within the spanning member and a portion that extends beyond the spanning member; and
continuous central member lower rebar that includes a portion within the spanning member and a portion that extends beyond the spanning member.

* * * * *